US006927689B2

(12) United States Patent
Frederiksen et al.

(10) Patent No.: US 6,927,689 B2
(45) Date of Patent: Aug. 9, 2005

(54) LASSO FOR SECURING AN OBJECT TO BE MONITORED AND A METHOD OF SECURING AN OBJECT TO BE MONITORED USING THE LASSO

(75) Inventors: Bjarne Frederiksen, Lombard, IL (US); Roger Leyden, Willow Springs, IL (US); Terrance Surma, Bloomingdale, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 10/642,771

(22) Filed: Aug. 18, 2003

(65) Prior Publication Data

US 2005/0040948 A1 Feb. 24, 2005

(51) Int. Cl.[7] ..... E05B 45/06

(52) U.S. Cl. ..... 340/542; 340/568.1; 340/568.2; 340/568.3; 340/571; 340/687

(58) Field of Search ..... 340/568.1, 568.2, 340/568.3, 571, 542, 548, 687, 691.3, 691.6; 70/14, 18, 30, 49, 58, 63, 19, 59

(56) References Cited

U.S. PATENT DOCUMENTS 4,132,987 A * 1/1979 Devereaux ..... 340/506
4,746,909 A * 5/1988 Israel et al. ..... 340/568.1
4,985,695 A * 1/1991 Wilkinson et al. ..... 340/568.3
5,020,192 A * 6/1991 Gerlach ..... 24/136 R
5,154,072 A 10/1992 Leyden
5,167,245 A * 12/1992 Harriett ..... 132/273
D345,092 S 3/1994 Leyden et al.
5,561,417 A * 10/1996 Rothbaum et al. ..... 340/568.2

* cited by examiner

*Primary Examiner*—Hung Nguyen
(74) *Attorney, Agent, or Firm*—Wood, Phillips, Katz, Clark & Mortimer

(57) ABSTRACT

A lasso for securing an object to be monitored. The lasso has a flexible cord with a length and first and second free ends, and a connector having a body with at least one opening therethrough. The portion of the flexible cord between the first and second free ends is directed through the at least one opening so that the connector and the portion of the flexible cord define a closed first loop with an effective diameter. The portion of the flexible cord is configurable to be generally U-shaped with a base and first and second legs which each project through the at least one opening. At least one of the first and second legs is movable relative to the fitting so that the effective diameter of the closed first loop is variable. The first free end of the flexible cord is directed through the closed first loop so as to define a closed second loop with an effective diameter that is variable by selectively oppositely moving the flexible cord through the closed first loop.

29 Claims, 4 Drawing Sheets

LASSO FOR SECURING AN OBJECT TO BE MONITORED AND A METHOD OF SECURING AN OBJECT TO BE MONITORED USING THE LASSO

BACKGROUND OF THE INVENTION

1. Field of the Invention

This invention relates to security systems and, more particularly, to a security system having a lasso made from a flexible cord for surrounding a portion of an object to be monitored. The invention is also directed to a method of securing an object using a lasso.

2. Background Art

Myriad systems are currently available for securing objects, as at point-of-purchase displays. One such system incorporates a flexible cord that is formed into a lasso which either extends around or through an object to be monitored. Examples of such lasso arrangements are shown in each of U.S. Pat. Nos. 5,154,072 and 5,279,135, commonly assigned herewith. Such a lasso arrangement is shown also in FIGS. 1 and 2 herein.

More particularly, as shown in FIGS. 1 and 2, a flexible cord 10 is bent into a U shape at 12 with a base 14 and first and second legs 16, 18. The first and second legs 16, 18 are bent against each other, as seen in FIG. 1, and secured by a crimp connector 20 so as to define a closed first loop at 22 with a fixed effective diameter. One free end 24 of the flexible cord 10 is directed through the closed first loop 22 to define a closed second loop 26 having an effective diameter which is variable by altering the extent to which the free end 24 of the flexible cable 10 is drawn through the closed first loop 22. The closed second loop 26 can be directed through a part of an object or around a part of an object, as hereinafter explained. The free end 24, and the opposite free end 28, can be suitably secured to maintain the lassoed object in a controlled range, as dictated by the length of the flexible cord 10.

The crimp connector 20 has the shape of an open FIG. 8, as seen in FIG. 2. The crimp connector 20 is joined with the flexible cord 10 by directing the free ends 24, 28 of the flexible cord 10 in the same direction through openings 30, 32 in the crimp connector 20 until both a) the desired lengthwise location of the closed first loop 22 along the length of the flexible cord and b) the desired effective diameter of the closed first loop 22, are established. Thereafter, the crimp connector 20 is deformed by a conventional crimping tool to compressibly capture both of the legs 16, 18 to maintain the configuration and location of the closed first loop 22.

The crimp connector 20 has a number of inherent drawbacks. First of all, the separate ends 24, 28 of the flexible cord 10 must be threaded through the openings 30, 32. Generally, the diameter of the flexible cord 10 is closely received in the openings 30, 32 so that the flexible cord 10 and crimp connector 20 can be positively united without requiring excessive deformation of the crimp connector 20. The flexible cord 10 may bind as it is directed through the openings 30, 32, particularly if there is any irregularity in the diameter of the flexible cord 10, as may occur in the event that the flexible cord 10 is bent.

It is common for this type of flexible cord 10 to have a braided metal core 34 with a surrounding non-metallic sheath 36. The tenacity of the connection between the crimp connector 20 and flexible cord 10 is maximized by locally stripping the flexible sheath 36 and deforming the crimp connector 20 around the exposed, braided core. The manufacturer or installer has to strategically strip the sheath 36 to expose the core 34 so as to allow the selected desired location, and a predetermined fixed effective diameter, of the closed first loop 22, to be established. Thus, each flexible cord 10 may have to be customized to a particular application. Alternatively, the crimp connector 20 can be formed against the outer sheath, which could potentially detrimentally compromise the strength of the connection between the crimp connector 20 and flexible cord 10.

Designers in the security industry are constantly seeking ways to construct systems, including lassos as a part thereof, which can be made economically while not compromising effectiveness. Costs may be saved by making this type of lasso universal in nature as opposed to requiring a customized configuration for each application.

SUMMARY OF THE INVENTION

In one form, the invention is directed to a lasso for securing an object to be monitored. The lasso has a flexible cord with a length and first and second free ends, and a connector having a body with at least one opening therethrough. The portion of the flexible cord between the first and second free ends is directed through the at least one opening so that the connector and the portion of the flexible cord define a closed first loop with an effective diameter. The portion of the flexible cord is configurable to be generally U-shaped with a base and first and second legs which each project through the at least one opening. At least one of the first and second legs is movable relative to the fitting so that the effective diameter of the closed first loop is variable. The first free end of the flexible cord is directed through the closed first loop so as to define a closed second loop with an effective diameter that is variable by selectively oppositely moving the flexible cord through the closed first loop.

In one form, the first free end of the flexible cord is attached to a fixed support.

The second free end of the flexible cord may be provided with an enlargement thereon which cannot be drawn through the at least one opening in the connector to open the closed first loop.

In one form, the enlargement is defined by a separate element that is fixedly attached to the flexible cord.

In one form, the separate element is crimped to the flexible cord.

In one form, the body of the connector has a flat plate through which the at least one opening is formed.

In one form, the at least one opening is a single opening within which the first and second legs reside.

The single opening may have an elongate shape.

The flexible cord may be a braided cable.

The braided cable may be surrounded by a non-metal sheath.

In one form, the flexible cord has an electrical conductor that defines a conductive path between the first and second free ends of the flexible cord.

The lasso may be provided in combination with an alarm system capable of producing a detectable signal in the event that the conductive path between the first and second free ends of the flexible cord is interrupted.

The lasso may be provided in combination with a support to which the first free end of the flexible cord is secured.

The lasso may also be provided in combination with an object having a fully surrounded opening. The portion of the flexible cord extends through the fully surrounded opening.

The invention is further directed to a lasso for securing an object to be monitored and having a flexible cord with a length and first and second free ends and a connector having a body with at least one opening therethrough. The portion of the flexible cord between the first and second free ends is directed through the at least one opening so that the connector and the portion of the flexible cord define a closed first loop with an effective diameter. The portion of the flexible cord is configurable to be generally U-shaped with a base and first and second legs which each project through the at least one opening. The first and second legs are each movable relative to the connector so that the effective diameter of the closed first loop is variable. The first end of the flexible cord is directed through the closed first loop so as to define a closed second loop with an effective diameter that is variable by selectively oppositely moving the flexible cord through the closed first loop.

In one form, the second free end of the flexible cord has an enlargement thereon which cannot be drawn through the at least one opening on the connector to open the closed first loop.

In one form, the flexible cord is in the form of an electrical conductor that defines a conductive path between the first and second free ends of the flexible cord.

The lasso may be provided in combination with an alarm system capable of producing a detectable signal in the event that the conductive path between the first and second free ends of the flexible cord is interrupted.

The lasso may be provided in combination with a fixed support to which the first free end of the flexible cord is secured.

In one form, the lasso is provided in combination with an object having a fully surrounded opening, with the portion of the flexible cord extending through the fully surrounded opening.

The invention is further directed to a method of securing an object to be monitored. The method includes the steps of: providing a flexible cord having a length and first and second free ends; providing a connector having at least one opening therethrough; directing a portion of the flexible cord between the first and second ends through the at least one opening so that the connector and the portion of the flexible cord define a closed first loop with a variable diameter; directing the first free end of the flexible cord around at least a part of an object and through the closed first loop to lasso the part of the object; and securing the first free end of the flexible cord to the support after the first free end of the flexible cord is directed through the closed first loop.

In one form, a portion of the flexible cord has a U shape with a base and first and second legs and the step of directing the portion of the flexible cord through the at least one opening involves pre-forming the portion of the flexible cord into the U shape and directing the pre-formed portion of the flexible cord base first through the at least one opening.

The method may further include the step of securing an element to the flexible cord that cannot be withdrawn from the at least one opening to open the closed first loop.

In one form, the step of providing a connector may involve providing a connector with a single opening through which the first and second legs of the flexible cord extend.

In one form, the step of providing a connector involves providing a flat element with a single opening therein to accept the portion of the flexible cord.

The method may further include the step of connecting the flexible cord to an alarm system capable of producing a detectable signal in the event that the flexible cord is severed between the first and second ends.

DETAILED DESCRIPTION OF THE DRAWINGS

Figure 1:
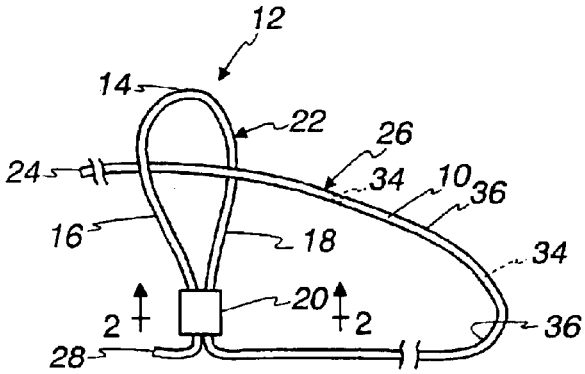
Fig. 1 (PRIOR ART)
FIG. 1 shows a conventional lasso for securing an object to be monitored and including a flexible cord formed into a closed first loop adjacent a first end of the flexible cord and with the other end of the flexible cord directed through the closed first loop to define a closed second loop of variable diameter.
Figure 2:
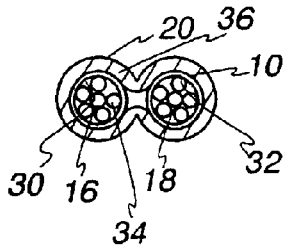
Fig. 2 (PRIOR ART)
FIG. 2 is an enlarged, cross-sectional view of a crimp connector on the flexible cord to maintain the configuration of the closed first loop and taken along line 2—2 of FIG. 1.

One preferred form of the invention is shown in FIGS. 3–11. The invention is directed to a lasso 40 consisting of a flexible cord 42 and a connector 44. The flexible cord 42 has a length L and first and second free ends 46, 48. The flexible cord 42, as seen most clearly in FIGS. 10 and 11, has a metal core 50 surrounded by a non-metallic sheath 52. The metal core 40 consists of a plurality of fibers 54 which are bundled into cords 56, which in turn are spirally wrapped to produce the desired diameter D for the metal core 50. The flexible cord 42 is preferably constructed so that it has flexibility that allows reconfiguration as described hereinbelow.

Figure 7:
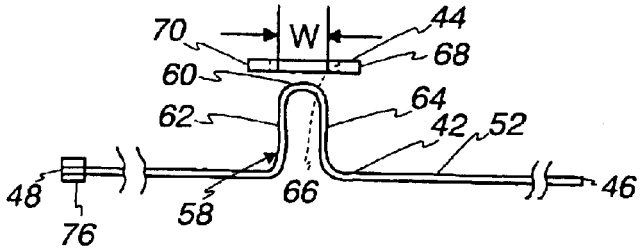
FIG. 7 is a view as in FIG. 3 with the flexible cord being directed through an opening in the connector to define the closed first loop.
Figure 8:
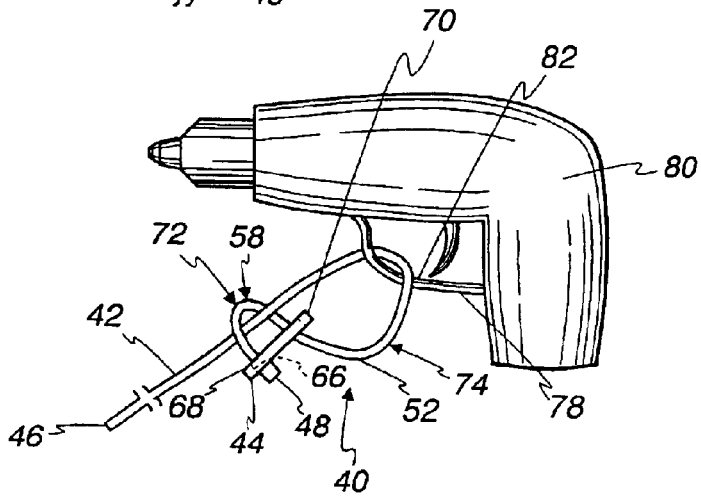
FIG. 8 is an elevation view of the lasso in FIG. 3 with the closed second loop directed through a fully surrounded opening on a portable drill.
Figure 9:
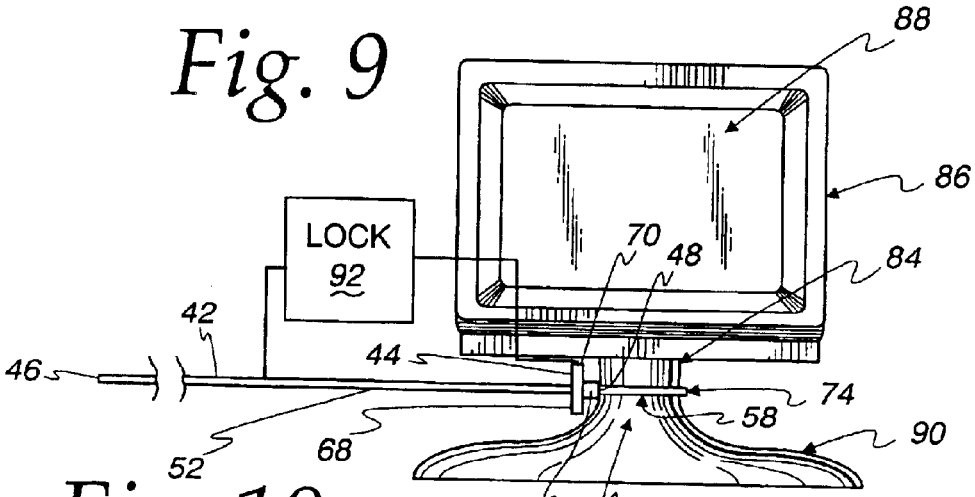
FIG. 9 is an elevation view of a computer monitor with the inventive lasso extended around a reduced diameter portion thereof.

The flexible cord 42 is joined with the connector 44 by configuring a portion of the flexible cord at 58 into a U shape, as seen particularly in FIG. 7. The preformed U-shaped consists of a base 60 and spaced first and second legs 62, 64. The U-shaped portion 58 is directed through an opening 66 in the connector 44. The opening 66 is elongate with a length L1 and a width W. The length L1 and width W are chosen to accommodate the U-shaped portion 58, configured as in FIG. 7. That is, the width W is made slightly greater than the outer diameter D1 (FIG. 10) of the flexible cord 42. The length L1 is selected depending upon the characteristics of the flexible cord 42. Ideally, the flexible cord 42 can be reconfigured to produce the U-shaped portion 58 without excessive force. The resulting width W (FIG. 7) of the U-shaped portion 58 is accommodated by the length L1 of the connector opening 66, preferably in such a manner that excessive force is not required to press the U-shaped portion 58 through the opening 66, as shown in FIGS. 3, 8 and 9.

The connector 44 is shown to have a flat body 68 with an outer, elliptical edge 70. The configuration of the edge 70 is not important and is made elliptical to correspond generally to the shape of the opening 66, so as to define a compact overall design. The flat construction of the body 68 facilitates construction of the connector 44 by a simple stamping operation using metal sheet stock. Preferably, the metal has a sufficient thickness T (FIG. 6) that it cannot be readily cut to compromise the overall system. The metal defining the body 68 may be hardened to achieve this end.

The connector 44 can take virtually any shape that lends itself to the formation of a suitable opening to accept the flexible cord portion 58. Likewise, the body 68 an be made from any metal or non-metal material which facilitates formation by any method, i.e. casting molding, known to those skilled in the art.

Figure 3:
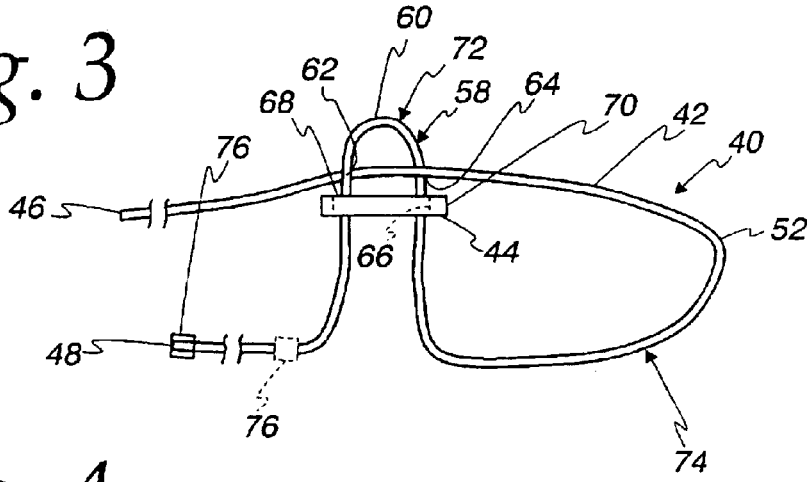
FIG. 3 is a view of the inventive lasso shown in a state corresponding to that in FIG. 1 and including a flexible cord and a connector through which the flexible cord is directed to define a closed first loop of variable diameter through which an end of the flexible cord can be directed to define a closed second loop having a variable diameter.
Figure 4:
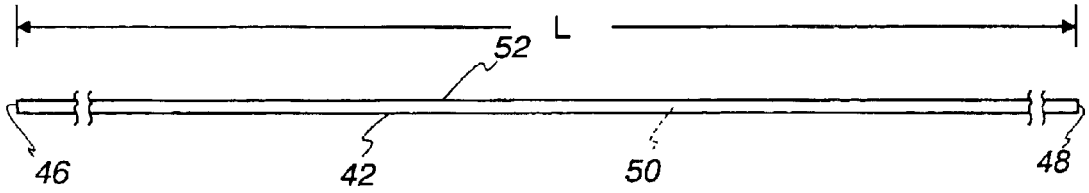
FIG. 4 is an elevation view of a flexible cord used to define the lasso in FIG. 3.
Figure 5:
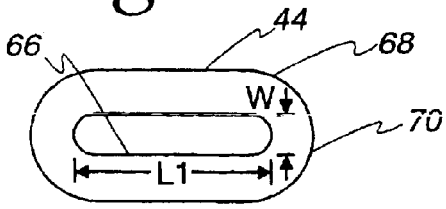
FIG. 5 is an enlarged, plan view of the connector in FIG. 3.
Figure 6:
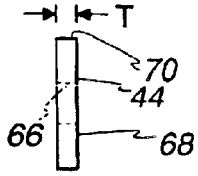
FIG. 6 is a side elevation view of the connector in FIG. 5.

Once the pre-formed U-shaped portion 58 is directed, base first, through the opening 66, a shown in FIG. 3, a closed first loop 72 is defined cooperatively by the legs 62, 64, the base 60, and the connector 44. The closed first loop 72 has an effective diameter that is variable by sliding the legs 62, 64 strategically oppositely through the connector opening 66. The invention further contemplates that one of the legs 62, 64 could be fixed to the connector 44, with the diameter of the closed first loop 72 selected by sliding the non-fixed leg 62, 64 within the connector opening 66.

Once the closed first loop 72 is formed, the first free end 46 of the flexible cord 42 can be directed therethrough to define a closed second loop 74 having a diameter that is likewise variable by moving the flexible cord strategically oppositely within the closed first loop 72.

Figure 10:
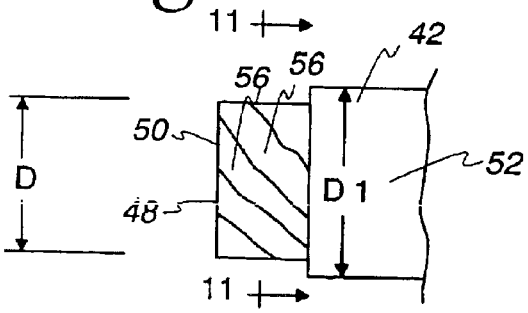
FIG. 10 is an enlarged, fragmentary, elevation view of one end of a flexible cord, useable with the present invention, and including a braided core and a surrounding sheath, with a portion of the sheath removed.
Figure 11:
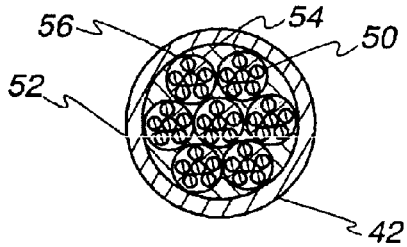
FIG. 11 is an enlarged, cross-sectional view of the flexible cord taken along line 11—11 of FIG. 10.

To prevent withdrawal of the first leg 62 from the opening 66, an enlargement 76 is formed at the second free end 48 of the flexible cord 42. The enlargement 76 is dimensioned so that it will not pass through the opening 66 as might otherwise allow the closed first loop 72 to be opened and thereby the system to be compromised. The enlargement 76 may be a conventional crimp connector that can be conventionally secured at the free end 48 of the flexible cord 42. As shown in FIG. 10, this connection may be facilitated by stripping the sheath 52 to expose the metal core 50 for direct contact with the connector 76.

It should be understood that while the flexible cord 42 has been described, and will be described below, with free ends 46, 48 which cooperate with various structures, it is not critical that any of those structures cooperate at the free ends 46, 48. For example, as shown in FIG. 3, the enlargement 76 is optionally shown at a location intermediate the first leg 62 and free end 48. That location thereby becomes functionally equivalent to the "free end" 48. Thus, throughout, it should be understood that references made to "free end" should not be limited to the location precisely at the free ends 46, 48 of the flexible cord 42.

In FIG. 8, the inventive lasso 40 is shown wrapped around a trigger guard 78 on a portable power drill 80. The trigger guard 78 bounds a fully surrounded opening 82. Once the closed first loop 72 is formed, the first free end 46 of the flexible cord 42 can be directed through the opening 82 and then through the closed first loop 72 to fully surround the trigger guard 78 and positively secure the drill 80. The first free end 46 of the flexible cord 42 can then be passed through a support, or otherwise secured, as hereinafter described. The passage of the flexible cord 42 through the closed first loop 72 prohibits the portion 58 from being withdrawn from the opening 66. Thus, the closed first and second loops 72, 74 are consistently maintained in the closed configuration, with each having a variable diameter.

In FIG. 9, the closed second loop 74 is shown constricted around a reduced diameter portion 84 of a computer monitor at 86. More particularly, the computer monitor 86 includes a display 88 and a base 90. The base 90 tapers to the reduced diameter portion 84 at the point of connection to the display 88. The closed second loop 74 can be enlarged in diameter to pass over the computer monitor 86 or base 90 after which it is reduced in diameter to the state shown in FIG. 9. A conventional type lock 92 can be incorporated to prevent sliding of the flexible cord 42 through the closed first loop 72 so as to maintain the secured connection show in FIG. 9.

Figure 12:
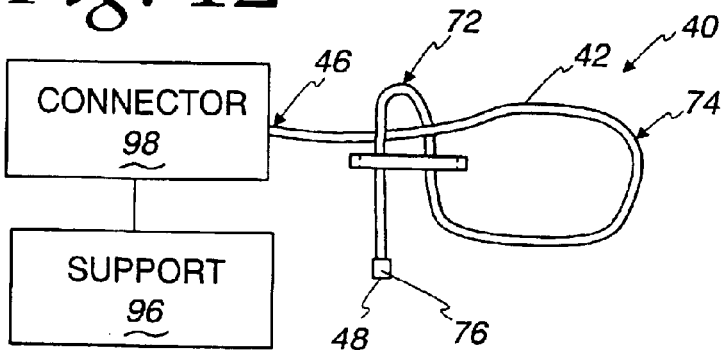
FIG. 12 is partially schematic view, corresponding to that in FIG. 3, with an end of the flexible cord secured to a support through a connector.

In FIG. 12, one possible arrangement for securing the first free end 46 of the flexible cord 42 is shown with the lasso 40 formed utilizing the closed first and second loops 72, 74. The first free end 46 of the flexible cord 42 can be joined to a support 96 releasably, or permanently, through a connector 98. The connector 98 can take virtually a limitless number of different forms. As one example, the flexible cord free end 46 could be formed into a loop which is joined to a loop on the support 96, as through a connector 98 in the form of a conventional padlock. The connector 98 may alternatively be a weld.

Figure 13:
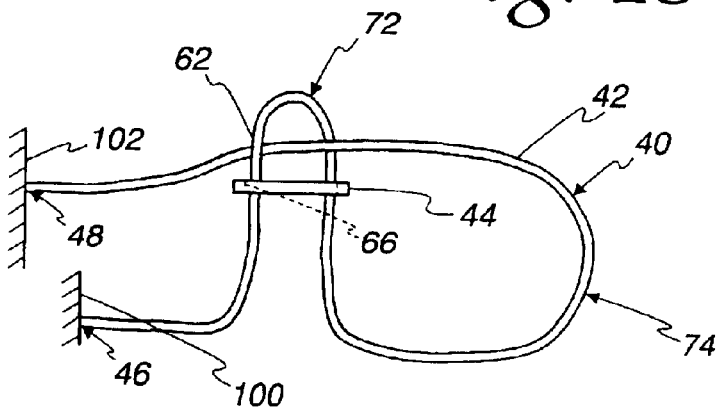
FIG. 13 is a modified form of lasso, shown in a state corresponding to that in FIG. 3 and with both ends of the flexible cord attached to a support.

In FIG. 13, a further embodiment of the invention is shown with the flexible cord 42 in the form of a lasso 40 with the closed first and second loops 72, 74, respectively. In FIG. 13, the need for the enlargement/connector 76 is obviated by connecting the first free end 46 of the flexible cord 42 to a support 100, which thereby prohibits withdrawal of the first leg 62 from the opening 66 in the connector 44. In this embodiment, the opposite flexible cord end 48 is suitably attached, either temporarily or permanently, to a separate support 102 or to the same support 100. The connection of the first free end 46 of the flexible cord 42 to the support 100 can be either permanent or temporary.

Figure 14:
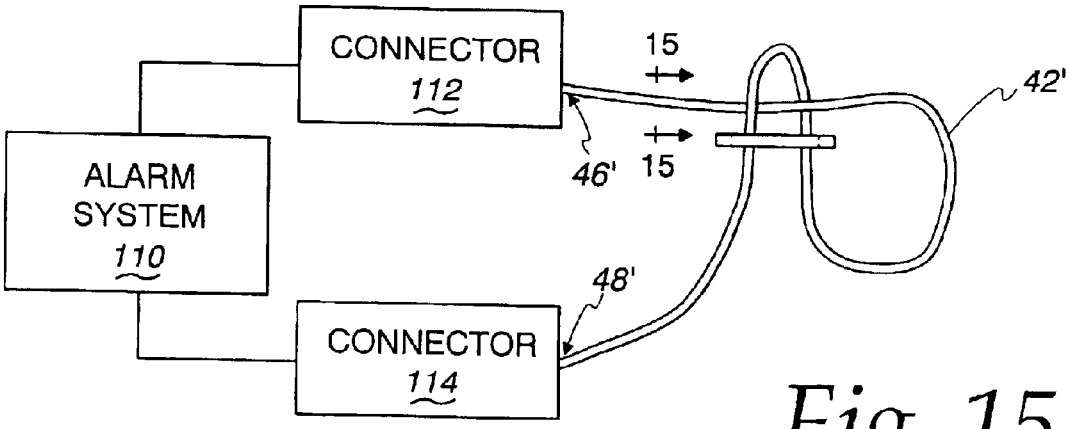
FIG. 14 is a partially schematic view similar to that in FIG. 13, of a modified form of lasso, wherein a flexible cord is operatively connected to an alarm system.
Figure 15:
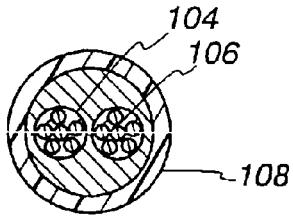
FIG. 15 is an enlarged, cross-sectional view of the flexible cord taken along line 15—15 of FIG. 14.

A still further form of the invention is shown in FIGS. 14 and 15, wherein a flexible cord 42' is made with one or two conductive elements 104, 106 which extend the length of the flexible cord 42'. A sheath 108 surrounds the conductive elements 104. The conductive elements 104, 106 provide a conductive path between the ends 46', 48' of the flexible cord 42'. In this embodiment, the conductive elements 104 and 106 are electrically connected to an alarm system 110 which is capable of producing a detectable signal. The conductive elements 104, 106 may be connected at their ends through appropriate electrical connectors 112, 114 to the alarm system 110 to preferably produce at least one continuous conductive path. Severance of the flexible cord 42' interrupts the conductive path to identify a breach of security which is detected by the alarm system 110 that generates the detectable signal, alerting the person or persons monitoring the system of a security breach.

Figure 16:
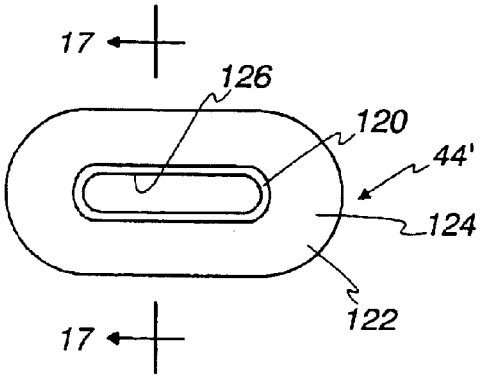
FIG. 16 is a view as in FIG. 5 of a modified form of connector, according to the invention.
Figure 17:
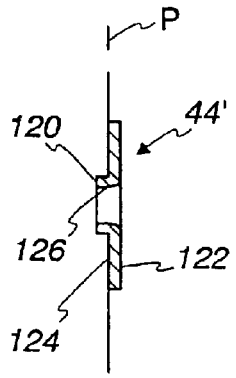
FIG. 17 is a cross-sectional view of the connector taken along line 17—17 of FIG. 16.

A modified form of connector, according to the present invention, is shown at 44' in FIGS. 16 and 17. The connector 44' has the same general overall configuration as the connector 44 and functions in the same manner. The only significant difference is that the edge 120 of the body 122 of the connector 44' is bent out of the plane P of the one flat body surface 124 continuously around the cable opening 126. This reinforces the connector 44', allowing it to be made with the required strength from a relatively thin material. The reinforcement makes the connector 44' more resistant to bending, and thus rupture induced by repetitive bending that might fatigue the metal of the body 122'.

Figure 18:
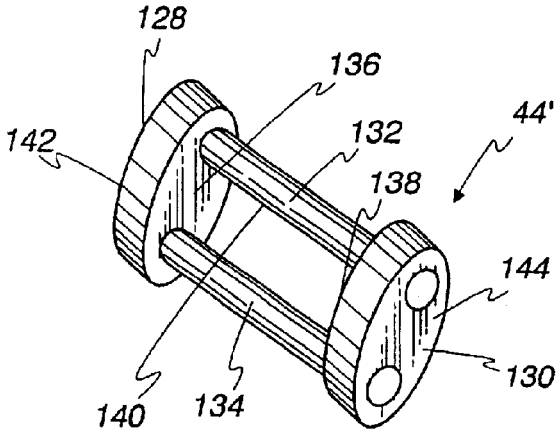
FIG. 18 is a perspective view of a further modified form of connector, according to the invention.
Figure 19:
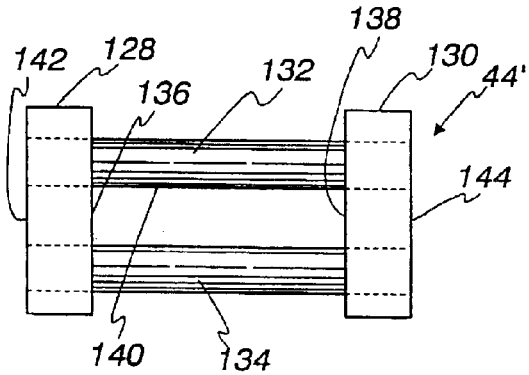
FIG. 19 is a plan view of the connector in FIG. 18.

In FIGS. 18 and 19, a further modified form of connector, according to the present invention, is shown at 44". The connector 44' lends itself to being constructed so as to be more tamperproof than the other connectors 44, 44'. The connector 44" has end caps 128, 130 which are joined by a pair of elongate rods 132, 134. The rods 132, 134, and facing surfaces 136, 138 on the end caps 128, 130 cooperatively bound a rectangular table opening 140.

In this embodiment, the rods 132, 134 are shown to be pressed through each of the end caps 128, 130 so as to be flush with the oppositely facing, end surfaces 142, 144 thereon. The rods 132, 134 can be conventionally press fit into, and frictionally held within, the end caps 128, 130. Alternatively, an adhesive or welds can be used to maintain the connection between the end caps 128, 130 and the rods 132, 134. The rods 132, 134 can be made from steel, and may be hardened for additional security. The connector 44" functions in the same manner as the connectors 44, 44', previously described.

Figure 20:
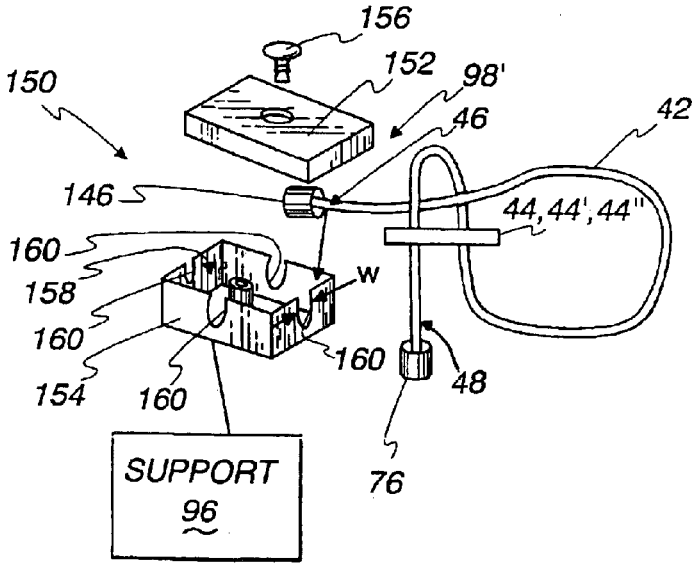
FIG. 20 is an exploded, perspective view of an exemplary structure for anchoring an end of a cable at an end opposite where the lasso is formed.

In FIG. 20, one exemplary form of connector, corresponding to the connector 98, previously described, is shown at 98'. A connector 146 is crimped to the first free cable end 46 in the same manner that the connector 76 is crimped at the free end 48 of the flexible cord 42. Any type of enlargement will function as described hereinbelow.

The connector 98' has a housing 150 defined by joinable halves 152, 154 which, when connected using a fastener 156, define a closed space 158. At least one, and in this case four, slots 160 are provided on the housing half 154, which is connected to the support 96. The slots 160 each have a width W that is sufficient to loosely accept the diameter of the flexible cord 42, but will not allow the connector 146 to pass therethrough.

With this construction, the housing halves 152, 154 can be separated by loosening the fastener 156. Thereafter, the connector 146 can be directed into the housing space 158, after which the housing half 152 can be joined to the housing half 154 so as to close the slot 16 in which the flexible cord 42 is placed. The connector 146 within the space 158 cannot move through the associated slot 160 and thus separation of the flexible cord end 46 from the housing 150 is precluded. A like connection can be made at the other slots 160.

The foregoing disclosure of specific embodiments is intended to be illustrative of the broad concepts comprehended by the invention.

What is claimed is:

1. A lasso for securing an object to be monitored, said lasso comprising:

a flexible cord having a length and first and second free ends; and a connector having a body with at least one opening therethrough, a portion of the flexible cord between the first and second free ends directed through the at least one opening so that the connector and the portion of the flexible cord define a closed first loop with an effective diameter, the portion of the flexible cord in generally a U-shaped configuration with a base and first and second legs which each project through the at least one opening, at least one of the first and second legs movable relative to the connector so that the effective diameter of the closed first loop is variable, the first free end of the flexible cord directed through the closed first loop so as to define a closed second loop with an effective diameter that is variable by selectively oppositely moving the flexible cord through the closed first loop.

2. The lasso for securing an object to be monitored according to claim 1 wherein the first free end of the flexible cord is attached to a fixed support.

3. The lasso for securing an object to be monitored according to claim 1 wherein the second free end of the flexible cord has an enlargement thereon which cannot be drawn through the at least one opening on the connector to open the closed first loop.

4. The lasso for securing an object to be monitored according to claim 1 wherein the body of the connector comprises a flat plate through which the at least one opening is formed.

5. The lasso for securing an object to be monitored according to claim 4 wherein the at least one opening comprises a single opening within which the first and second legs reside.

6. The lasso for securing an object to be monitored according to claim 1 wherein the at least one opening comprises a single opening into which the base and first and second legs can be directed by movement, base first, into the single opening with the base and first and second legs in the U-shaped configuration.

7. The lasso for securing an object to be monitored according to claim 3 wherein the enlargement is defined by a separate element that is fixedly attached to the flexible cord.

8. The lasso for securing an object to be monitored according to claim 1 wherein the flexible cord comprises a braided cable.

9. The lasso for securing an object to be monitored according to claim 1 wherein the flexible cord comprises an electrical conductor that defines a conductive path between the first and second free ends of the flexible cord.

10. The lasso for securing an object to be monitored according to claim 1 in combination with a fixed support to which the first free end of the flexible cord is secured.

11. The lasso for securing an object to be monitored according to claim 9 in combination with an alarm system capable of producing a detectable signal in the event that the conductive path between the first and second free ends of the flexible cord is interrupted.

12. The lasso for securing an object to be monitored according to claim 1 in combination with an object having a fully surrounded opening and the portion of the flexible cord extends through the fully surrounded opening.

13. The lasso for securing an object to be monitored according to claim 8 wherein the braided cable is surrounded by a non-metal sheath.

14. The lasso for securing an object to be monitored according to claim 7 wherein the separate element is crimped to the flexible cord.

15. A lasso for securing an object to be monitored, said lasso comprising:

a flexible cord having a length and first and second free ends; and a connector having a body with at least one opening therethrough, a portion of the flexible cord between the first and second free ends directed through the at least one opening so that the connector and the portion of the flexible cord define a closed first loop with an effective diameter, the portion of the flexible cord in generally a U-shaped configuration with a base and first and second legs which each project through the at least one opening, the first and second legs each movable relative to the connector so that the effective diameter of the closed first loop is variable, the first free end of the flexible cord directed through the closed first loop so as to define a closed second loop with an effective diameter that is variable by selectively oppositely moving the flexible cord through the closed first loop.

16. The lasso for securing an object to be monitored according to claim 15 wherein the second free end of the flexible cord has an enlargement thereon which cannot be drawn through the at least one opening on the connector to open the closed first loop.

17. The lasso for securing an object to be monitored according to claim 15 wherein the flexible cord comprises an electrical conductor that defines a conductive path between the first ands second free ends of the flexible cord.

18. The lasso for securing an object to be monitored according to claim 15 in combination with a fixed support to which the first free end of the flexible cord is secured.

19. The lasso for securing an object to be monitored according to claim 17 in combination with an alarm system capable of producing a detectable signal in the event that the conductive path between the first and second free ends of the flexible cord is interrupted.

20. The lasso for securing an object to be monitored according to claim 15 in combination with an object having a fully surrounded opening and the portion of the flexible cord extends through the fully surrounded opening.

21. A method of securing an object to be monitored, said method comprising the steps of:

providing a flexible cord having a length and first and second free ends;

providing a connector having at least one opening therethrough;

directing a portion of the flexible cord between the first and second free ends through the at least one opening so that the connector and the portion of the flexible cord define a closed first loop with a diameter that is variable by sliding the flexible cord through the at least one opening;

directing the first free end of the flexible cord around at least a part of an object and through the closed first loop to lasso the part of the object, the first free end of the flexible cord directed through the closed first loop with the flexible cord remaining slidable through the at least one opening such that the diameter of the closed first loop can be varied as the first free end of the flexible cord is directed through the closed first loop; and securing the first free end of the flexible cord to a support after the first free end of the flexible cord is directed through the closed first loop.

22. The method of securing an object to be monitored according to claim 21 wherein the portion of the flexible cord has a U shape with a base and first and second legs, the step of directing the portion of the flexible cord through the at least one opening comprises pre-forming the portion of the flexible cord into the U shape and directing the pre-formed portion of the flexible cord base first through the at least one opening.

23. The method of securing an object to be monitored according to claim 22 further comprising the step of securing an element to the flexible cord that cannot be withdraw from the at least one opening to open the closed first loop.

24. The method of securing an object to be monitored according to claim 22 wherein the step of providing a connector comprises providing a connector with a single opening through which the first and second legs of the flexible cord extend.

25. The method of securing an object to be monitored according to claim 21 wherein the step of providing a connector comprises providing a flat element with a single opening therein to accept the portion of the flexible cord.

26. The method of securing an object to be monitored according to claim 21 further comprising the step of connecting the flexible cord to an alarm system capable of producing a detectable signal in the event that the flexible cord is severed between the first and second ends.

27. A method of securing an object to be monitored, said method comprising the steps of:

providing a flexible cord having a length and first and second free ends;

providing a connector having at least one opening therethrough;

directing a portion of the flexible cord between the first and second free ends through the at least one opening so that the connector and the portion of the flexible cord define a closed first loop with a variable diameter;

directing the first free end of the flexible cord around at least a part of an object and through the closed first loop to lasso the part of the object; and securing the first free end of the flexible cord to a support after the first free end of the flexible cord is directed through the closed first loop, wherein the portion of the flexible cord has a U shape with a base and first and second legs and the step of directing the portion of the flexible cord through the ast least one opening comprises pre-forming the portion of the flexible cord into the U shape and directing the pre-formed portion of the flexible cord base first through the at least one opening.

28. A method of securing an object to be monitored, said method comprising the steps of:

providing a flexible cord having a length and first and second free ends;

providing a connector having at least one opening therethrough;

directing a portion of the flexible cord between the first and second free ends through the at least one opening so that the connector and the portion of the flexible cord define a closed first loop with a variable diameter;

directing the first free end of the flexible cord around at least a part of an object and through the closed first loop to lasso the part of the object; and securing the first free end of the flexible cord to a support after the first free end of the flexible cord is directed through the closed first loop, wherein the step of providing a connector comprises providing a connector with a single opening through which the first and second legs of the flexible cord extend.

29. The lasso for securing an object to be monitored according to claim 15 wherein the at least one opening comprises a single opening into which the base and first and second legs can be directed by movement, base first, into the single opening with the base and first and second legs in the U-shaped configuration.

* * * * *